US010027055B2

(12) United States Patent
Larssen et al.

(10) Patent No.: US 10,027,055 B2
(45) Date of Patent: Jul. 17, 2018

(54) CONDUCTOR CONTACT TIP

(71) Applicant: NEXANS, Paris (FR)

(72) Inventors: Jens Ludvig Larssen, Halden (NO); Jan Erik Karlsen, Kolbotn (NO)

(73) Assignee: NEXANS, Paris (FR)

( * ) Notice: Subject to any disclaimer, the term of this patent is extended or adjusted under 35 U.S.C. 154(b) by 32 days.

(21) Appl. No.: 14/536,811

(22) Filed: Nov. 10, 2014

(65) Prior Publication Data

US 2015/0155650 A1 Jun. 4, 2015

(30) Foreign Application Priority Data

Dec. 3, 2013 (NO) ..... 20131599

(51) Int. Cl.

| | |
|---|---|
| ***H01R 13/523*** | (2006.01) |
| ***H01R 11/26*** | (2006.01) |
| ***H01R 11/11*** | (2006.01) |
| *H01R 4/50* | (2006.01) |

(52) U.S. Cl.

CPC ..... *H01R 13/523* (2013.01); *H01R 4/5091* (2013.01); *H01R 11/11* (2013.01); *H01R 4/5025* (2013.01)

(58) Field of Classification Search

CPC .. H01R 13/523; H01R 4/5091; H01R 4/5025; H01R 11/26; H01R 13/5205

See application file for complete search history.

(56) References Cited

U.S. PATENT DOCUMENTS

| | | | | |
|---|---|---|---|---|
| 2,463,145 | A * | 3/1949 | Buchanan | H01R 4/52 403/199 |
| 4,588,252 | A * | 5/1986 | Ice | B23K 9/26 439/724 |
| 4,850,777 | A * | 7/1989 | Lawrence | F16B 37/0864 403/305 |
| 5,683,273 | A * | 11/1997 | Garver | H01R 4/5025 174/84 R |
| 6,220,902 | B1 * | 4/2001 | Ivandic | F16C 7/023 439/727 |
| 6,916,193 | B2 * | 7/2005 | Varreng | H01R 13/523 439/201 |
| 7,467,979 | B2 * | 12/2008 | Colescott | H01R 4/5091 439/784 |
| 7,473,129 | B2 * | 1/2009 | Jackson | H01R 13/5205 439/589 |
| 8,215,410 | B2 * | 7/2012 | Jackson | E21B 17/003 166/188 |
| 8,286,309 | B2 * | 10/2012 | Landry | F16G 11/048 24/122.6 |
| 9,240,655 | B2 * | 1/2016 | Diop | H01R 13/641 |

* cited by examiner

*Primary Examiner* — Michael A Lyons
*Assistant Examiner* — Matthew T Dzierzynski
(74) *Attorney, Agent, or Firm* — Sofer & Haroun, LLP

(57) ABSTRACT

A conductor contact is provided having a sleeve (2) with an opening adapted to receive a free end (1) of a conductor. A contact tip (3) with an opening (35) is adapted to receive the sleeve (2), where the sleeve (2) has a tapered outer surface (21) on a compressible section surrounding the opening. The contact tip (3) has a tapered surface inside the opening adapted to compress the compressible section of the sleeve when the 10 contact tip surrounds the sleeve (2), and an outer smooth surface (34).

10 Claims, 4 Drawing Sheets

CONDUCTOR CONTACT TIP

The present invention relates to a male contact tip, especially a contact tip for subsea positioning and clamping on a conductor by use of a Remotely Operated Vehicle (ROV) tool.

BACKGROUND

It is well known to provide heating cable systems for the transfer of electrical power to production pipelines lying on the seabed. EP1381117 discloses a subsea connector applicable for in situ repair of such a cable system. The present invention relates to a contact tip especially applicable for use in connecting cable ends to such a subsea connector, but not limited thereto.

Above sea level crimping ferrules or crimping contact sleeves is the common method of preparing conductor tips adapted for jointing.

At a subsea level the arrangement of a contact tip should be performable by a ROV tool. A further requirement for a subsea contact tip is that it should be smooth without deformed areas caused by crimping tools. The smooth surface is needed to ensure that interface tolerance requirements with the connector and its contact lamellas are fulfilled.

PRIOR ART

WO2007/146852 discloses a subsea connector contact, comprising an inner conical sleeve with gripping fingers and internally threaded bore. An outer tip portion with an internal conical surface is secured to the sleeve with a screw, whereby the gripping fingers are collapsed about a conductor. The connector contact is not adapted for handling by a ROV-tool and the diameter thereof is considerable larger than the diameter of the cable, providing an uneven surface between the surface of the cable and the surface of the connector contact. This solution comprises a number of open spaces wherein sea water could be collected if these are not filled.

OBJECTIVES OF THE INVENTION

The present invention aims at providing a smooth male contact tip.

Further the present invention aims at providing a conductor contact tip adapted for installation by a ROV-tool.

The present invention also aims at providing a conductor contact for use in wet environments, especially subsea environments.

Further the present invention aims at providing a conductor contact for a piggy-back cable, especially for a piggy-back cable for a direct electrical heating system for use in connection with a subsea connector for in situ subsea repair of a cable.

The present invention provides a conductor contact comprising

- a sleeve with an opening adapted to receive a free end of a conductor,
- a contact tip with an opening adapted to receive the sleeve, wherein the sleeve comprises a tapered outer surface on a compressible section surrounding said opening, wherein the contact tip comprises a tapered surface inside the opening adapted to compress the compressible section of the sleeve when the contact tip surrounds the sleeve and an outer smooth surface.

In one aspect of the conductor contact according to the present invention the contact tip has an outer circumference at the opening substantially equivalent to a circumference of the conductor at an axil distance from the free end substantially equivalent to the axial depth of the opening in the sleeve adapted to receive the free end thereby providing a smooth transition from the surface of the conductor to the surface of the conductor contact.

In a further aspect of the conductor contact it comprises a first connection element and a second connection element, wherein the first connection element is connectable to the second connection element.

The first connection element can be made of materials such as Alloy 625 or 25CrDuplex.

The second connection element can be made of materials such as bronze alloys.

In one aspect of the present invention the first connection element and the second connection element connects the sleeve with the contact tip and the connection of the first and second connection elements provides the pressure to compress the sleeve and arrange it within the opening in the contact tip.

In another aspect of the present invention the sleeve and the contact tip are made of cupper.

In a further aspect of the conductor contact the sleeve comprises an end section opposite the opening adapted to receive the conductor, wherein the thickness in the axial direction of the end section is less than the distance from the axis to the circumference of the end section. In yet another aspect the thickness is 60% or less of the distance from the axis to the circumference of the end section.

Further in another aspect the conductor contact is a conductor contact for subsea wet repair, especially for in situ subsea repair of a direct heating cable.

In yet another aspect of the present invention the conductor contact is a subsea, wet repair conductor contact.

The conductor contact according to the present invention can especially be employed as a conductor contact for a piggy back cable. A back cable is arranged on the outside of a subsea pipeline, and the contacting of the cable will often take place in the wet environment surrounding the subsea pipeline.

BRIEF DESCRIPTION OF THE DRAWINGS

The present invention will be described in further detail with reference to the enclosed drawings illustrating an embodiment of the present invention. The drawings are schematic representations of one embodiment of the present invention, and modifications can be made without departing from the main concept of the present invention as defined by the claims.

PRINCIPAL DESCRIPTION OF THE INVENTION

Figure 1:
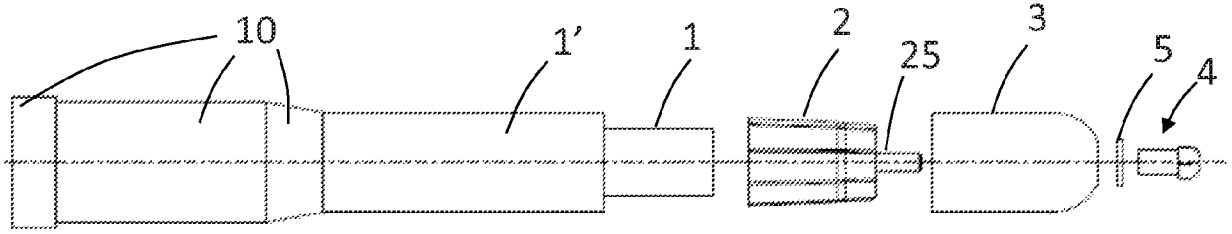
FIG. 1 illustrates the elements of a first embodiment of the contact tip prior to assembling.

An embodiment of the present invention is illustrated on FIG. 1 showing an exploded view of the conductor end and the elements of the conductor contact to be assembled therewith. The conductor 1' comprises a free end section 1 adapted to receive the conductor contact tip. Further away from the end section 1 the conductor may be surrounded by sheeting, insulation layers, protection layers 10 etc.

The conductor contact comprises a contact sleeve 2 with an opening adapted to receive the free end 1 and comprising first connection element 25. In the illustrated embodiment the first connection element 25 is a screw with the head arranged within the sleeve 2 and the threaded part protruding out of the sleeve in the axial direction. The conductor contact further comprises a contact tip 3 with and opening adapted to receive and compress the sleeve 2 and comprising an axial opening for connecting a second connection element 4 to the first connection element 25. In the illustrated embodiment the second connection element is a nut with an inner thread adapted to receive and engage with the thread on the screw. Further the conductor contact may optionally comprise a washer 5 arranged between the second connection element 4 in the form of a nut and the contact tip 3.

Figure 2:
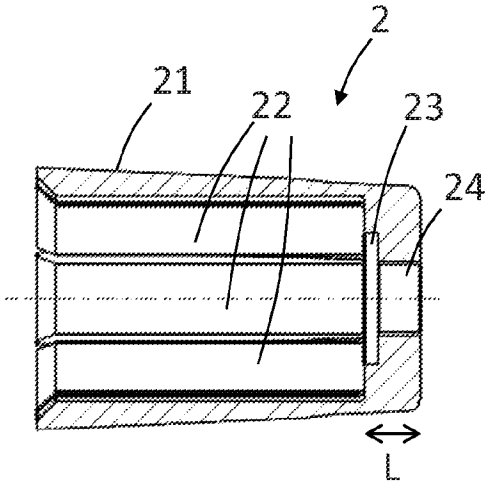
FIG. 2 illustrates a cross sectional view of a first embodiment of the contact sleeve.

FIG. 2 illustrates the sleeve 2 in further detail by showing a cross sectional view thereof along the longitudinal axis thereof. The sleeve comprises a plurality of finger elements 22 forming the opening adapted to receive the free end 1 of the conductor. The outer surface 21 of the sleeve has a conical shaped and the openings between the finger elements allows for the fingers to be compressed and grip the free end 1 of the conductor when arranged within the opening adapted to receive said end. Further the sleeve comprises a through hole 24 opposite the opening adapted to receive the free end of the conductor. The through hole 24 is adapted to receive a part of the connection means and making it available for connection with the second connection element. The first connection elements preferably comprises a head section with a larger diameter than the diameter of the through hole 24. Inside the through hole 24 the sleeve may optionally comprise a recess 23 adapted to receive and hold the head of the first connection element. The material thickness of the sleeve in the direction of the longitudinal axis is marked L on FIG. 2. As the through hole 24 isn't required to comprise holding means such as threads which would require a significant thickness, the thickness L is limited by the need to provide material strength to retain the head of the first connection element.

The sleeve 2 is made of a conducting material, preferably cupper or a cupper alloy.

Figure 3:
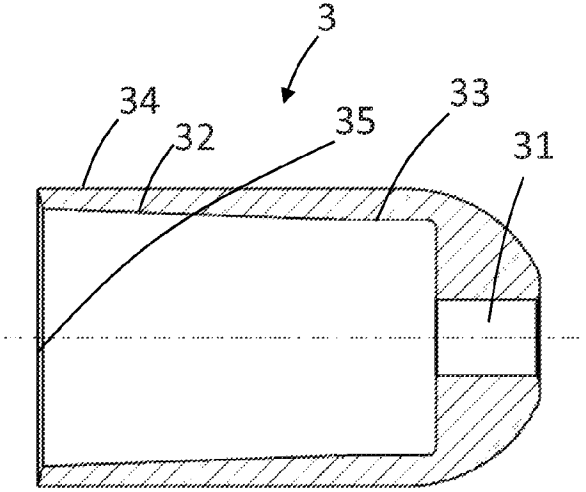
FIG. 3 illustrates a cross sectional view of a first embodiment of the contact tip.

FIG. 3 illustrates the contact tip 3 in further detail by showing across sectional view thereof along the longitudinal axis thereof. The contact tip comprises a smooth outer surface 34 and an opening 35 adapted to receive and compress the sleeve 2. The inner surface of the opening comprises a conically shaped outer section 32 of the opening and optionally an inner cylindrical section 33. The angle of the conical section 32 is smaller than the angle of the conical outer surface 21 of the sleeve 2 in the uncompressed position as illustrated on FIG. 2. When the sleeve is inserted into the opening 35 the smaller angle of the inner conical surface 32 compresses the fingers of 22 of the sleeve when the outer surface 21 is brought in contact with the inner conical section 32. Opposite the opening 35 in the longitudinal direction the tip comprises a through hole 31 with a smaller cross-sectional area than the end of the sleeve 2. The through hole 31 is adapted to receive the first connection element 25. The first connection element can be inserted true the through hole 24 in the sleeve and into the through hole 31 in the contact tip 3. Further the through hole 31 is adapted for a part of the second connection element 4 to be past into the through hole 31 from the outside at the free end of the contact tip 3, opposite the opening 35. The second connection element is connected to the first connection element within the through hole 31.

Figure 4:
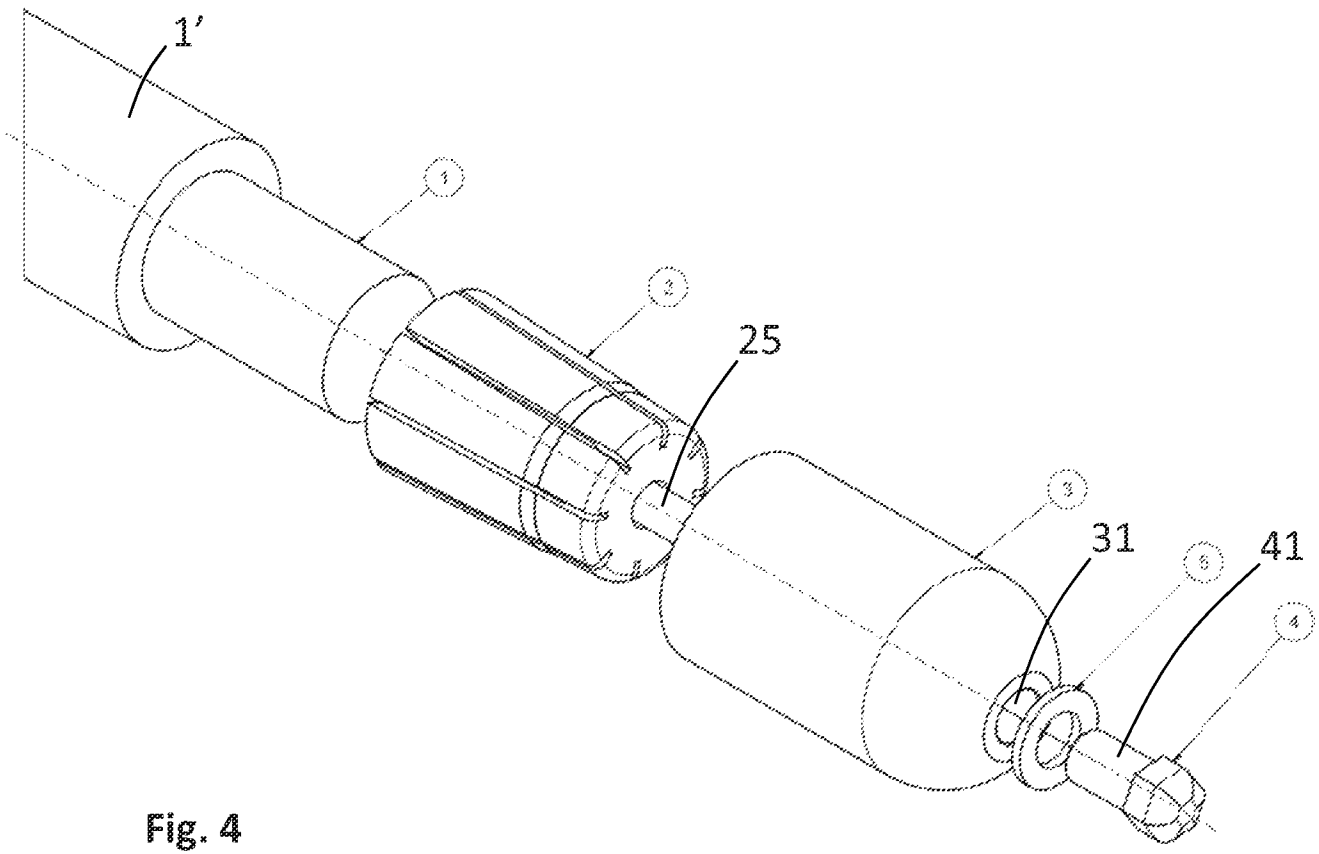
FIG. 4 illustrates the exploded view of a first embodiment of the conductor contact.

FIG. 4 illustrates an exploded view of the conductor contact. The first connection element 25 extends out of the through hole in the sleeve 2. The second connection element 4 comprises a cylindrical section 41 to be past into the through hole 31. The cylindrical section 41 comprises an inner threaded opening adapted to be screwed onto the outer threads on the first connection element.

Figure 5A:
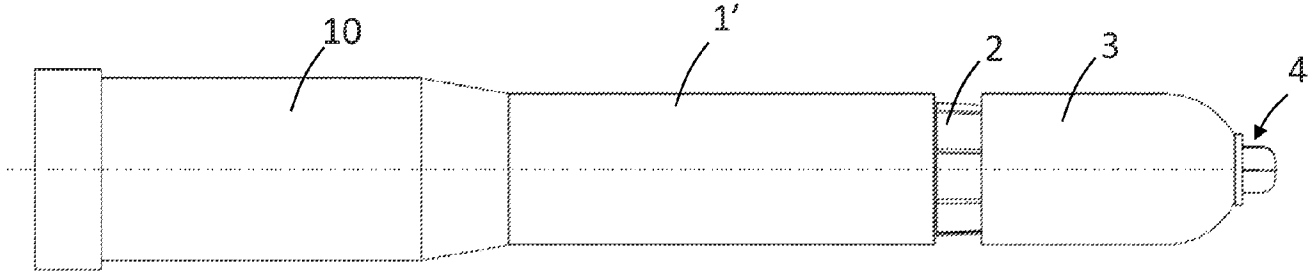
FIGS. 5*a* and 5*b* illustrates the cable contact prior to and after compression of the tip onto the cable respectively.
Figure 5B:
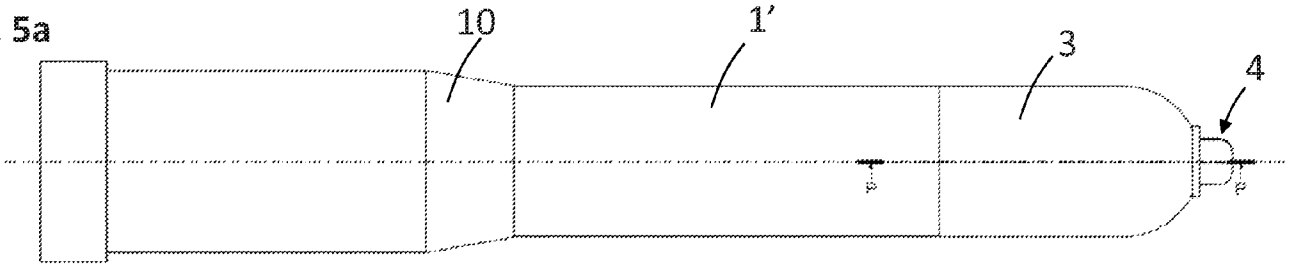

The FIGS. 5*a* and 5*b* illustrate a conductor contact according to the present invention when being arranged on a conductor 1' and when the arranging is completed, respectively. Visible on FIG. 5*a* are the fingers of the sleeve 2 that during connection of the conductor tip are fully covered by the contact tip 3 as illustrated on FIG. 5*b*. The contact tip 3 connected to the conductor 1' provides as illustrated on FIG. 5*b* a smooth cylindrical surface. The force necessary for securing the contact to the conductor by compressing the sleeve 2 within the tip 3 is in this embodiment provided by the torque on the second connection element 4, where the internal threaded bore is screwed onto the first connection element.

Figure 6:
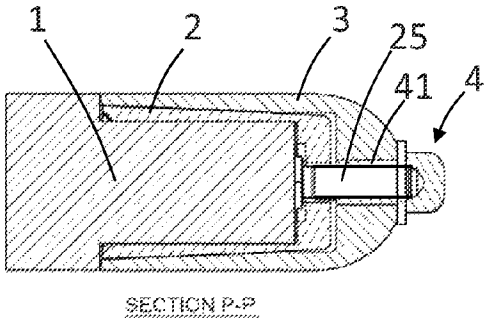
FIG. 6 is a cross sectional view of the assembled tip according to FIG. 5*b*.

The points P-P on FIG. 5*b* illustrate the position of the cross-sectional view illustrated as section P-P on FIG. 6. From this figure it can be seen how the first connection element 25 is arranged within the cylindrical section 41 of the second connection element 4. FIG. 6 also illustrates that when placed on a conductor the contact tip provides a structure with limited open spaces between the different elements making up the conductor contact. In a preferred embodiment these open spaces/areas are filled with a medium to prevent seawater contamination.

In one embodiment such a filling can be done after assembly when the conductor tip enters a membrane of a joint body of a subsea connector. Poly-isobutene present inside the joint body will protrude into the contact tip by passing through small holes in the front of the contact tip (these holes are not shown on the drawings). Thus the seawater contaminated inside will be exchanged with poly-isobutene.

Alternatively the parts of the conductor tip can be pre filled with a calculated volume of electrical conductive grease, before assembled to the cable end. This grease should preferably not protrude out of the "open end" of the conductor tip and onto the cable insulation, as the grease is conductive.

The figures illustrate one embodiment of the present invention however it should be understood that alternative embodiments are equally possible. Such alternatives could include the opposite configuration of the first and the second connection elements, where the first element comprises a threaded bore and the second connection element comprises an out threaded section adapted to be screwed into the bore of the first connection element.

In another alternative the first connection element is an integrated part of the sleeve element and not a separate element.

In a further alternative embodiment the second connection element is an integrated part of the contact tip.

In a further alternative embodiment of the present invention the conductor contact consists of a sleeve and a tip.

Figure 7:
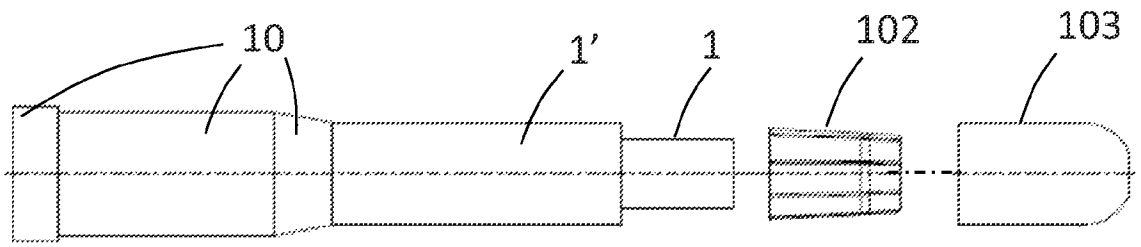
FIG. 7 illustrates schematically en exploded view of a second embodiment of the present invention.
Figure 8:
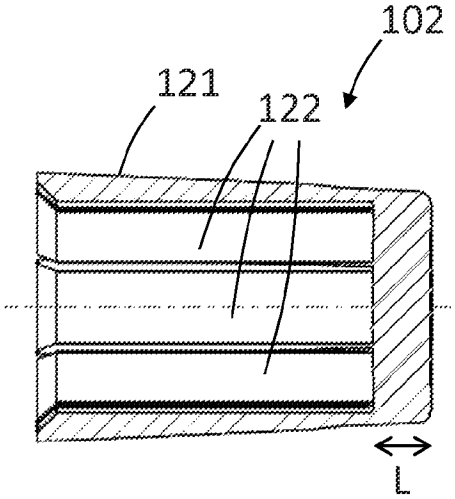
FIG. 8 illustrates a cross sectional view of a second embodiment of the contact sleeve.
Figure 9:
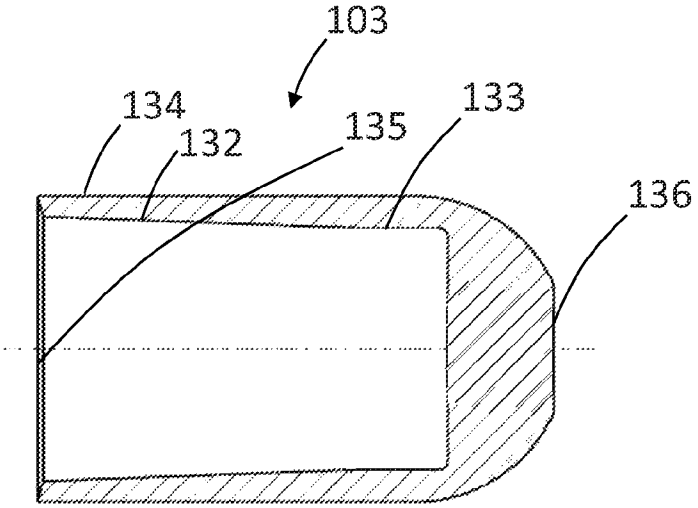
FIG. 9 illustrates a cross sectional view of a second embodiment of the contact tip.

FIGS. 7, 8 and 9 illustrate a second embodiment of the present invention. Here the conductor contact comprises a sleeve 102 and a contact tip 103. Further details of the sleeve 102 are illustrated on FIG. 8. The sleeve comprises fingers 122 providing a tapered outer surface 121. The openings between the fingers 122 allows for the sleeve 102 to be compressed when the contact tip 103 is pressed in the axial direction towards the sleeve arranged on the conductor end 1. The details of the contactor tip 103 are illustrated on FIG. 9. The opening 135 adapted to receive the sleeve comprises a tapered surface 132 with an angle relative to the central axis which is small than the angle of the tapered surface 121 of the sleeve 102. The inner section 133 of the surface may as illustrated be parallel to the center axis and not tapered as the section 132 close to the opening 135. The outer side surface 134 of the contact tip 103 is smooth and preferably not tapered. The end surface 136 at the free end of the contact tip preferably has a rounded shape, like a dome, but may as illustrated comprise a flat tip area to provide axial pressure on the contact tip to secured it on the sleeve and thereby fastening the sleeve to the free end of the conductor.

The invention claimed is:

1. Conductor contact comprising:

a sleeve with an opening adapted to receive a free end of a conductor, a contact tip with an opening adapted to receive the sleeve, wherein the sleeve comprises a tapered outer surface on a compressible section surrounding said opening, wherein the contact tip comprises a tapered surface inside the opening adapted to compress the compressible section of the sleeve when the contact tip surrounds the sleeve, and an outer smooth surface and wherein the contact tip has an outer circumference at the opening providing an external surface continuity from the surface of the conductor to the surface of the conductor contact, wherein an outer smooth surface of the contact tip is cylindrical and has the same diameter as the diameter of the conductor at an axial distance from the free end of said conductor substantially equivalent to the axial depth of the opening of the sleeve.

2. Conductor contact according to claim 1, wherein the conductor contact comprises a first connection element and a second connection element, wherein the first connection element is connectable to the second connection element.

3. Conductor contact according to claim 2, wherein the first connection element and the second connection element connect the sleeve with the contact tip and the connection of the first and second connection elements provides the pressure to compress the sleeve and arrange it within the opening in the contact tip.

4. Conductor contact according to claim 1, wherein the sleeve and the contact tip are made of cupper.

5. Conductor contact according to claim 1, wherein the sleeve comprises an end section opposite the opening adapted to receive the conductor, wherein the thickness in the axial direction of the end section is less than the distance from the axis to the circumference of the end section.

6. Conductor contact according to claim 5, wherein the thickness is 60% or less of the distance from the axis to the circumference of the end section.

7. Conductor contact according to claim 1, wherein the conductor contact is a subsea, wet repair conductor contact.

8. Conductor contact according to claim 7, wherein the conductor contact is a conductor contact for subsea wet repair of a direct heating cable.

9. Conductor contact according to claim 1, wherein the smooth cylindrical surface is provided from the surface of the conductor to the surface of the conductor contact when the contact tip is connected to the conductor.

10. Conductor contact according to claim 1, wherein the contact tip faces the conductor when the conductor contact is secured to the conductor.

* * * * *